United States Patent [19]

Nishimura et al.

[11] 4,419,019

[45] Dec. 6, 1983

[54] ANALOG DISPLAY TYPE ELECTRONIC TIMEPIECE

[75] Inventors: Katsuo Nishimura; Minoru Watanabe, both of Tokorozawa, Japan

[73] Assignee: Citizen Watch Company Limited, Tokyo, Japan

[21] Appl. No.: 368,325

[22] Filed: Apr. 14, 1982

[30] Foreign Application Priority Data

Apr. 14, 1981 [JP] Japan ..... 56-055124

[51] Int. Cl.[3] ..... G04B 23/02; G04B 19/04

[52] U.S. Cl. ..... 368/74; 368/80

[58] Field of Search ..... 368/72–74, 368/76, 80, 250, 251

[56] References Cited

U.S. PATENT DOCUMENTS 4,223,523 9/1980 Kamijo ..... 368/72

4,358,840 11/1982 Ono et al. ..... 368/251

*Primary Examiner*—Vit W. Miska

*Attorney, Agent, or Firm*—Jordan and Hamburg

[57] ABSTRACT

An analog display type of electronic timepiece is provided with an alarm function, whereby changeover can be rapidly performed between display of current time and of a preset alarm time, by rapid rotation of the timepiece hands, and features means whereby the hands are advanced in steps of less than one minute during the current time display state but are advanced by steps of precisely one minute while setting of an alarm time is being carried out, so that the alarm time is precisely set with the minutes hand positioned at a minutes graduation on the dial.

5 Claims, 4 Drawing Figures

φ1
φ2
φ3
φ4
φ6
φ7
φAR
58
60
62
64
66
68
70
72
74
76
78
80
82
S
R
Q20
Q22
Q21

ANALOG DISPLAY TYPE ELECTRONIC TIMEPIECE

BACKGROUND OF THE INVENTION

The present invention relates to an analog type of electronic timepiece, i.e. an electronic timepiece provided with analog display means such as time indicating hands driven by an electro-mechanical transducer, which is provided with an alarm function, and in particular to an analog electronic timepiece which is provided with means whereby the alarm time can be set to a desired value easily and accurately.

At present, various types of digital or combined analog/digital electronic timepieces are available which can provide an alarm function having a very high degree of accuracy, i.e. such that an alarm time can be set to a precision of the order of a few seconds. However it has proven much more difficult to provide such a highly accurate alarm function in an analog electronic timepiece. Although there are on the market at present a few analog electronic timepieces which provide an alarm function, the accuracy is in general relatively poor, by comparison with that available from digital types of timepiece. One of the reasons for this is that it is difficult to set an alarm time accurately and easily, with such a prior art type of analog electronic timepiece. This setting is generally performed by rotating an external operating member, such as a timepiece crown, and thereby generating signal pulses which are applied to drive an electro-mechanical transducer (usually a miniature stepping motor) to successively advance the hands to the desired alarm time setting. Usually, during the normal current time display state of such an analog electronic timepiece, the hands are advanced by the stepping motor in steps of less than one minute in amplitude, e.g. in steps of 20 seconds or 30 seconds. One of the main reasons for this is that the operation of such a miniature stepping motor is made more efficient and stable as the amplitude of each drive step is reduced, in other words less energy is required to advance the motor from one position to the next as the amplitude of each step is reduced, and in addition a greater stability of the stepping motor rotor position is attained, with respect to external disturbing influences, as the amplitude of each step is reduced. For this reason, when the user performs setting of an alarm time, by rotation of an external operating member, the stepping motor will advance the hands in steps of less than one minute at a time, e.g. 10 seconds, 20 seconds, 30 seconds, in response to each pulse generated by actuation of the external actuating member. Thus, it is difficult for the user to set the minutes hand of the timepiece precisely at a desired minutes units position, i.e. positioned precisely at one of the minutes graduations on the timepiece dial. Thus, for example, if the user attempts to set in a time of 8:00 (i.e. 8 o-clock) as the alarm time, then if the timepiece is slightly tilted with respect to the viewing position of the user when setting is carried out, a time of 7:59:30 (i.e. 7 hours, 59 minutes, 30 seconds) may be actually set as the alarm time, or a time of 8:00:30 (i.e. 8 hours, zero minutes, 30 seconds). There are some conditions in which it is required to generate an alarm signal at a precisely determined time, and thus, with such a prior art analog electronic timepiece the alarm signal will be emitted at an instant which is slightly delayed or advanced with respect to the desired alarm time, and this will give the user the impression that the timepiece is inaccurate in its time measurement capabilities. However in fact this inaccuracy is due to the fact that it is difficult for the user to set the alarm time to the desired value with a high degree of precision.

There is therefore a requirement for an analog electronic timepiece which would overcome the problem outlined above, and to enable the user to easily and conveniently set a desired alarm time, without having to pay a great deal of care to the setting operation.

SUMMARY OF THE INVENTION

The present invention comprises an analog electronic timepiece which overcomes the difficulties of precisely setting an alarm time, encountered with prior art types of analog electronic timepiece, and which enables the user to rapidly and easily set an alarm time accurately, with the setting being performed in units of minutes, although the timepiece hands are advanced in units of less than a minute during a current time display mode.

With an analog electronic timepiece according to the present invention, when changeover from a current time display mode to an alarm time setting mode is performed, then setting of an alarm time can be thereafter performed by rotating an external operating member, whereby the timepiece hands are advanced in steps of one minute at a time. This is accomplished by providing circuit means whereby, in response to each alarm time setting signal pulse generated by rotation of that external operating member, a plurality of drive pulses, equivalent to advancement by one minute, are applied to drive the stepping motor of the timepiece, and hence the hands. A corresponding number of pulses are input at the same time to counter circuit means which memorize the difference between the alarm time and the current time, with these counter circuit means serving thereafter to generate a signal indicating when the alarm time coincides with the current time, whereby an alarm signal is generated. Since the timepiece hands are always advanced in steps of one minute at a time during the alarm time setting mode, and since the minutes hand is always positioned at a minutes graduation on the timepiece dial when changeover to the alarm time setting mode is performed, setting of the alarm time to a precisely accurate value of hours and minutes can be rapidly and easily carried out.

DESCRIPTION OF THE PREFERRED EMBODIMENTS

Figure 1:
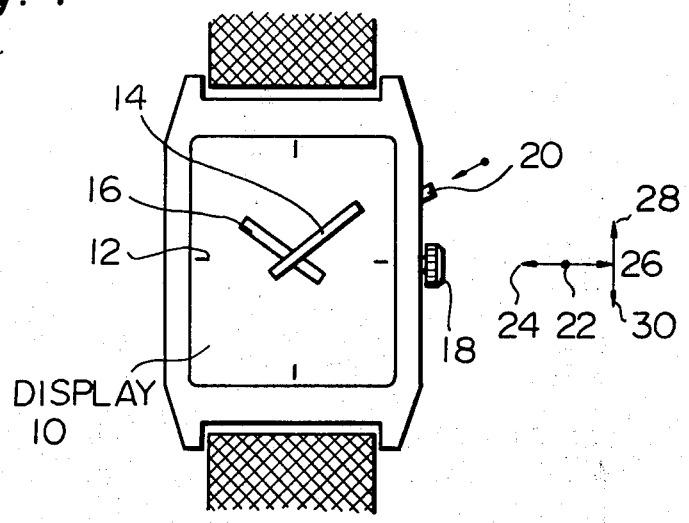
FIG. 1 is a plan view of an embodiment of an analog electronic timepiece according to the present invention.

Referring now to the drawings, FIG. 1 is a plan view of an embodiment of an analog electronic timepiece according to the present invention. This has an analog display 10 comprising a graduated dial plate 12, a minutes hand 14 and hours hand 16, and is provided with external operating members comprising a pushbutton 20 and a crown 18, each coupled to switches which are not shown in the drawings. The crown 18 is used for initiating changeover between a current time display mode, a current time setting mode, a alarm time display mode, and an alarm time setting mode, and for performing setting (i.e. correction) of the current time or of an alarm time. The crown 18 is normally left in a position 22, in which the current time or an alarm time will be displayed by minutes hand 14 and hours hand 16 of display 10. If current time is being displayed, and crown 18 is depressed into a position denoted by numeral 24, then changeover from the current time display mode to the alarm time display mode is initiated. During this changeover, the minutes hand 14 and hours hand 16 are rapidly rotated from positions indicating the current time into positions indicating a preset alarm time. In this condition, if crown 18 is again depressed into position 24, then changeover from the alarm time display mode to the current time display mode will be initiated, by minutes hand 14 and hours hand 16 being rapidly rotated into positions once more indicating the current time.

With the timepiece in the current time display mode, if crown 18 is pulled outward to a position denoted by numeral 26 in FIG. 1, then the crown will remain in that position, and is rotatable, and the timepiece will now be in the current time setting mode. In this mode, rotation of crown 18 in the clockwise direction, denoted by numeral 28, will result in minutes hand 14 and hours hand 10 being rotated in the clockwise direction, in successive steps. In the current time display mode, minutes hand 14 and hours hand 16 are advanced once every 20 seconds, i.e. three times per minute, by a stepping motor as described hereinafter. During setting of the current time in the current time setting mode, minutes hand 14 and hours hand 16 are rotated through one step of 20 seconds amplitude each time a switch is actuated by rotation of crown 18, in the rotation thereof, with each of these switch actuations being indicated to the user by a "click" sound being emitted by crown 18. However, during the alarm time setting mode, which is established by setting the timepiece first in the alarm time display mode as described above and then pulling crown 18 out to position 26, the minutes hand 14 and hours hand 16 are advanced by one step of an amplitude of one minute, for each "click" emitted by crown 18 during rotation of the crown to perform setting of an alarm time. In this way, the user can set an alarm time with minutes hand 14 positioned at a precisely determined time, e.g. at the "12 o-clock" graduation on display 10.

Figure 2:
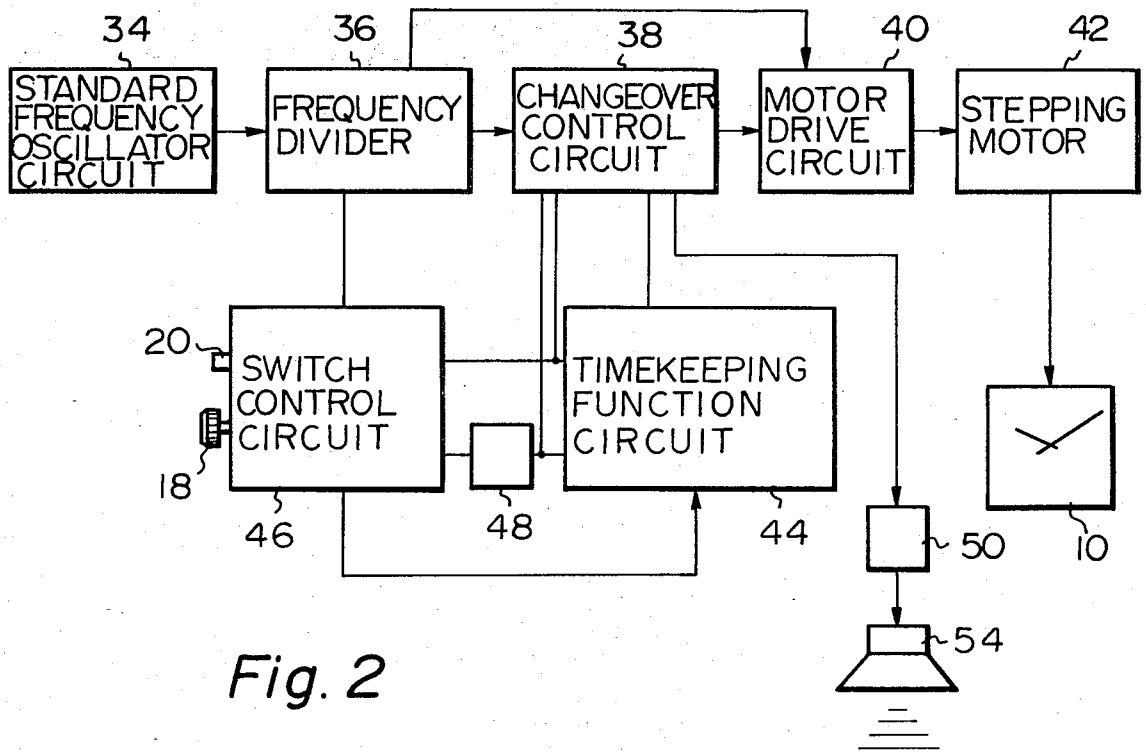
FIG. 2 is a block circuit diagram of the analog electronic timepiece embodiment of FIG. 1.

FIG. 2 is a block diagram of the timepiece embodiment of FIG. 1. This comprises a standard frequency oscillator circuit 34, which generates a standard frequency timebase signal to be frequency divided by a frequency divider circuit 36. Frequency divider circuit 36 thereby generates a unit time signal, for successively advancing the time displayed by minutes hand 14 and hours hand 16 in the current time display mode and also various timing signal pulses. In this embodiment, since minutes hand 14 and hours hand 16 are advanced once every 20 seconds in the current time display mode, as described above, the unit time signal from frequency divider circuit 36 comprises a pulse train having a period of 20 seconds. This signal is input to a changeover control circuit 38, which performs various functions described hereinafter, but which transfers the unit time signal from frequency divider circuit 36 to the input of a motor drive circuit 40, when the timepiece is operating in the current time display mode. The motor drive circuit 40 thereby generates drive pulses for driving a stepping motor 42, which is coupled to minutes hand 14 and hours hand 16, and thereby acts to advance these hands once every 20 seconds.

The changeover control circuit 38 also serves to transfer the unit time signal pulses to a timekeeping function circuit 44, which serves to store data representing the time difference between current time and a preset alarm time, as described hereinafter, this time difference being continually decremented as current time elapses. Signals generated by switch actuations through operation of crown 18 or pushbutton 20 are converted into switch signals of suitable waveform by a switch control circuit 46, and these switch signals are applied to changeover control circuit 38 and to timekeeping function circuit 44 to perform the mode changeover and time setting operations described hereinabove. In order to provide rotation of minutes hand 14 and hours hand 16 in steps of one minute at a time during alarm time setting in the alarm time setting mode as described above, setting signals pulses generated by rotation of crown 18 during alarm time setting are processed by an alarm setting pulse generating circuit 48, as will be described in detail hereinafter, and the output pulses from this circuit are applied to timekeeping function circuit 44 and changeover control circuit 38.

When coincidence occurs between the preset alarm time and the current time, then a signal is generated by timekeeping function circuit 44, and is transferred by changeover control circuit 38 to an alarm drive circuit 50, which responds by generating an alarm drive signal to drive an alarm device 54 to produce an audible alarm signal. The alarm device 54 comprises an electro-acoustic transducer.

Figure 3:
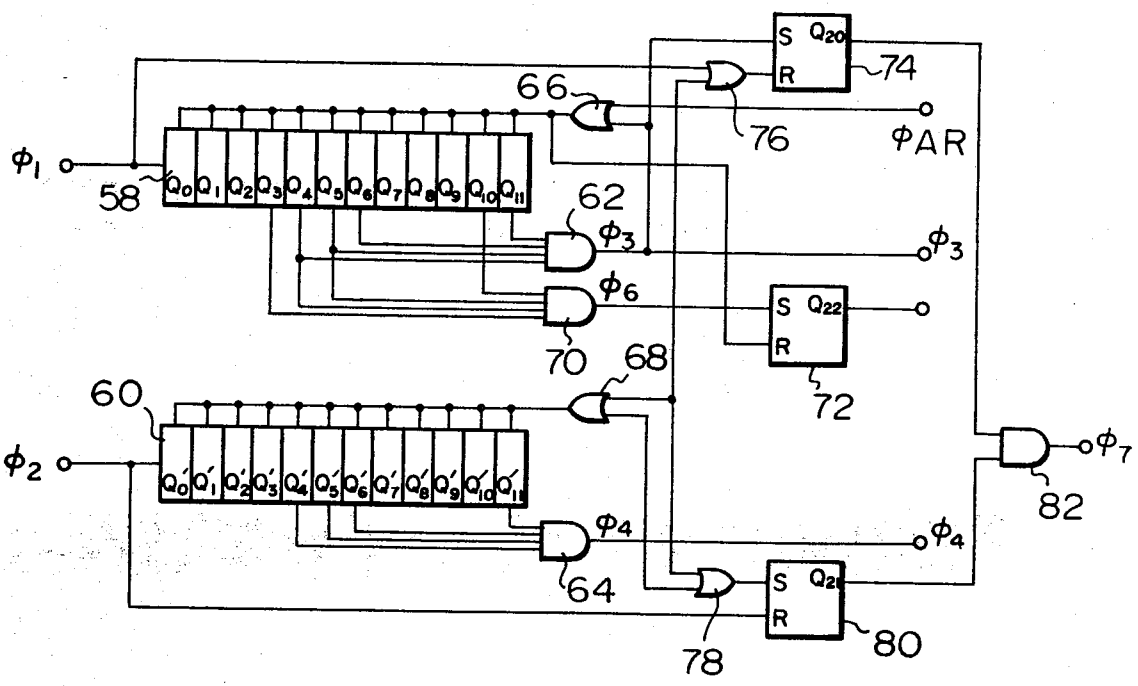
FIG. 3 is a circuit diagram of a timekeeping function circuit used in the embodiment of FIG. 1 and FIG. 2.

Referring now to FIG. 3, an example of timekeeping function circuit 44 is shown. This comprises a main counter circuit 58, a secondary counter circuit 60, AND gates 62, 65, 70 and 82, OR gates 69, 66, 76 and 78, and set-reset flip-flops (hereinafter abbreviated to RS-FF) 72, 74 and 80. The main counter circuit 58 serves to store a quantity which represents the time difference between the preset alarm time and the current time, so that as the current time elapses, the latter quantity must be continually decremented. Pulses of a signal $\phi 1$, transferred by changeover control circuit 38 are input to main counter circuit 58 and are counted up by that circuit. Pulses of an input signal $\phi 2$, applied to secondary counter circuit 60 from changeover control circuit 38, are counted up by circuit 60. Normally, the pulses applied as input signal $\phi 1$ comprise the unit time signal from frequency divider circuit 36 referred to above, i.e. the pulse train of 20 seconds period which also acts to periodically advance the minutes hand 14 and hours hand 16 in the current time display mode The quantity stored in main counter circuit 58 representing the difference between the preset alarm time and the current time comprises the difference between the maximum count value attainable by main counter circuit 58 and the current count value in that circuit. Thus, since the contents of main counter circuit 58 are incremented once every 20 seconds, and since the maximum difference between alarm time and current time which must be stored corresponds to 12 hours, main counter circuit 58 must be able to store a maximum count of 2160 (i.e. $3 \times 60 \times 12$) pulses of signal $\phi 1$. Thus, main counter circuit 58 comprises 12 binary counter stages, whose outputs are designated as Q0, Q1, . . . Q11. It is necessary for the operation of the timekeeping function circuit 44, as described hereinafter, that the maximum count of secondary counter circuit 60 be identical to that of main counter circuit 58, and so this counter also has 12 stages, whose outputs are designated as Q0', Q1', . . . Q11'.

The attainment of the maximum count value 2160 in main counter circuit 58 is detected by AND gate 62, whose inputs are coupled to outputs Q11, Q6, Q5 and Q4 of main counter circuit 58, and whose output signal $\phi$3 goes to the high logic level potential (referred to hereinafter as the H level) when the maximum count is attained in main counter circuit 58. Similarly, when the maximum count is attained in secondary counter circuit 60, this is detected by the output of an AND gate 64, designated as $\phi$4, going to the H level, the inputs of AND gate 64 being coupled to outputs Q4, Q5, Q6 and Q11 of secondary counter circuit 60. AND gate 70 is coupled to detect a count value in main counter circuit 58 representing 6 hours, i.e. a count of 1080. The inputs of AND gate 70 are therefore coupled to receive outputs Q10, Q5, Q4 and Q3 from main counter circuit 58, and the output signal $\phi$6 from AND gate 70 goes to the H level when a count of 1080 is reached in main counter circuit 58. When this occurs, the RS-FF 72 is set by signal $\phi$6 whereby an output Q22 from that flip-flop is set to the H level. Thus, when the maximum count is reached in main counter circuit 58, then the H level state of signal $\phi$3 causes the output of OR gate 66 to go to the H level, thereby resetting RS-FF 72. It can thus be understood that while the count in main counter circuit 58 is within the range 0 to 1079, output signal Q22 will be at the low logic level potential (referred to hereinafter as the L level), while when the count in main counter circuit 58 is within the range 1080 to 2059, then output Q22 will be at the H level. When signal $\phi$3 goes to the H level, the output from OR gate 66 acts to reset the count in main counter circuit 58 to zero. Similarly, when the maximum count of 2160 is reached in secondary counter circuit 60, then the H level of signal $\phi$4 causes the output from OR gate 68 to go to the H level, thereby resetting the count in secondary counter circuit 60 to zero. Signal $\phi$3 acts to set an RS-FF 74 output Q20 to the H level when the count in main counter circuit 58 is reset to zero, while the signal $\phi$4 acts through an OR gate 78 to set an RS-FF 80, when the maximum count in secondary counter circuit 60 is reached, whereby an output signal Q21 goes to the H level. Signals Q20 and Q21 are input to an AND gate 82. Thus, if the contents of main counter circuit 58 reach the maximum value while the count in secondary counter circuit 60 is zero, an alarm coincidence signal $\phi$7 from AND gate 82 will go to the H level, thereby indicating that the current time has reached coincidence with the preset alarm time.

An "all reset" signal $\phi$AR is generated under various predetermined conditions, such as at the instant when changeover is performed from the current time setting mode to the current time display mode. This signal $\phi$AR acts through OR gate 76 to reset RS-FF 74, acts through OR gate 66 to reset main counter circuit 58 to a count of zero, and similarly resets the count in secondary counter circuit 60 to zero and sets RS-FF 80 so that signal Q21 is set to the H level, and furthermore reset RS-FF 72 so that signal Q22 goes to the L level.

The operation of this circuit will now be described. As stated above, when crown 18 is depressed into position 24, then changeover between the current time display mode and the alarm time display mode is initiated. If the current time display mode has been selected, the current time setting mode can then be selected by pulling crown 18 outward to a position 26 shown in FIG. 1. Time setting signal pulses are then generated by switch control circuit 46 in response to rotation of crown 18 as described above. If the speed of rotation of crown 18 is raised above a predetermined value, then time setting signal pulses begin to be automatically generated at a rate of 64 Hz, as rapid advancement pulses for rapidly rotating the minutes hand 14 and hours hand 16 into a desired position When crown 18 is returned to the normal position 22 after completion of current time setting, then the "all reset" signal $\phi$AR is generated, as a pulse at the H level, whereby frequency divider circuit 36 and the counter circuits in timekeeping function circuit 44 are reset as described above. 20 seconds later, the first pulse of the unit time signal is generated and transferred by changeover control circuit 38 to be converted into a drive pulse by motor drive circuit 40, so that minutes hand 14 and hours hand 16 begin to be advanced three times per minute in the current time display mode. As stated above, the counts in main counter circuit 58 and secondary counter circuit 60 are reset to zero at the instant of return to the current time display mode, by signal $\phi$AR. Thereafter, beginning at the instant 20 seconds after return to the current time display mode, unit time signal pulses will be input as signal $\phi$1 to main counter circuit 58, three times per minute, and counted up by that counter. Thus, precisely 12 hours after the instant of return to the current time display mode from the current time setting mode, the maximum count value will be reached in main counter circuit 58, and alarm coincidence signal $\phi$7 will go to the H level, thereby activating alarm drive circuit 50 to drive alarm device 54 to emit an audible alarm signal. In other words, when the timepiece is returned from the current time setting mode to the current time display mode, then the current time which has thus been set will also be automatically be set as the alarm time.

The state of signal Q22 indicates whether the time difference between the alarm time and the current time is greater than or less than 6 hours, and is therefore used to control the direction of changeover between the display of current time and display of alarm time, i.e. to designate whether such a changeover is performed by rotation of minutes hand 14 and hours hand 16 in the clockwise or in the counterclockwise direction.

Changeover operations of the timekeeping function circuit 44 between the current time and alarm time display modes will be described, illustrated by specific examples. First, it will be assumed that changeover from the current time setting mode to the current time display mode has been carried out and the "all reset" signal $\phi$AR generated from switch control circuit 46, at the instant when the current time is 4:30, so that frequency divider circuit 36 and timekeeping function circuit 44 are reset at that instant. After 2 hours have elapsed, then the current time of 6:30 will be displayed by minutes hand 14 and hours hand 16, and since the unit time signal pulses are input to main counter circuit 58 with a period of 20 seconds, the count in main counter circuit 58 will now have reached 360. Signal Q22 will therefore be at the L level. If at this moment changeover from the current time display mode to the alarm time display mode is initiated by depressing crown 18 into position 24, then a mode changeover signal will be output from switch control circuit 46. The changeover control circuit 38 responds to the latter signal by applying train of timing signal pulses from frequency divider circuit 36, at a frequency of 2048 Hz, simultaneously as input signals $\phi 1$ and $\phi 2$ to be counted up by main counter circuit 58 and secondary counter circuit 60. Input of these signals is continued until the count in main counter circuit 58 reaches maximum and is reset to zero, i.e. until 1800 pulses have been counted by main counter circuit 58 and secondary counter circuit 60. Thus, a count of 1800 is now held in secondary counter circuit 60, and the count in main counter circuit 58 is zero. The changeover control circuit 38 thereafter applies a train of timing signal pulses from frequency divider circuit 38 at a frequency of 64 Hz, simultaneously to be counted by secondary counter circuit 60 (i.e. as signal $\phi 2$), and as the input signal to motor drive circuit 40 such as to generate reverse rotation drive pulses. Application of these timing signal pulses is continued until the count in secondary counter circuit 60 reaches maximum and is reset to zero, i.e. until 360 pulses have been counted by secondary counter circuit 60. Thus, upon termination of these timing signal pulses, the minutes hand 14 and hours hand 16 will have been rotated in the reverse direction (i.e. counterclockwise) by two hours, so that the alarm time of 4:30 will be displayed, this alarm time having been set at the instant of changeover back from the current time setting mode to the current time display mode.

If on the other hand, changeover from the alarm time to the current time display mode is initiated at the instant when the current time is 6:30, with the displayed alarm time being 4:30, then in this case the processsing performed by the timekeeping function circuit 44 is similar to that described in the last paragraph, but in this case the stepping motor 42 is driven to rotate minutes hand 14 and hours hand 16 rapidly in the clockwise direction, by drive pulses synchronized with timing signal pulses applied to main counter circuit 58 and secondary counter circuit 60.

If the preset alarm time is assumed to be 8:30, and if changeover from the current time display mode to the alarm time display mode is initiated when the current time is 6:30, then in this case the count in main counter circuit 58 at the moment of changeover will be 1800. The changeover control circuit 38 applies timing signal pulses. e.g. at 64 Hz, to be counted simultaneously by main counter circuit 58 and secondary counter circuit 60, until the count in main counter circuit 58 reaches maximum and is reset to zero, with drive pulses being applied synchronously with these timing signal pulses to drive stepping motor 42 to rotate minutes hand 14 and hours hand 16 in the clockwise direction. Thus, at the end of this changeover, the count in secondary counter circuit 60 is 360 and that in main counter circuit 58 is zero, while the minutes hand 14 and hours hand 16 indicate the alarm time of 8:30. Post-processing is then performed, by changeover control circuit 38 applying timing signal pulses at a frequency of 2048 Hz to be counted simultaneously by main counter circuit 58 and secondary counter circuit 60, as signals $\phi 1$ and $\phi 2$, until the maximum count is reached in secondary counter circuit 60 is reached, and it is reset to zero. Thus, the original count value of 1800 will now be stored in main counter circuit 58 by this post-processing.

If changeover from the alarm time display mode to the current time setting mode is performed with an alarm time of 8:30, at the instant when the current time is 6:30, then the operations of timekeeping function circuit 44 whereby minutes hand 14 and hours hand 16 are rapidly rotated to indicate the current time will be identical to those described in the preceding paragraph. However in this case the hands will be rotated in the counterclockwise direction.

Figure 4:
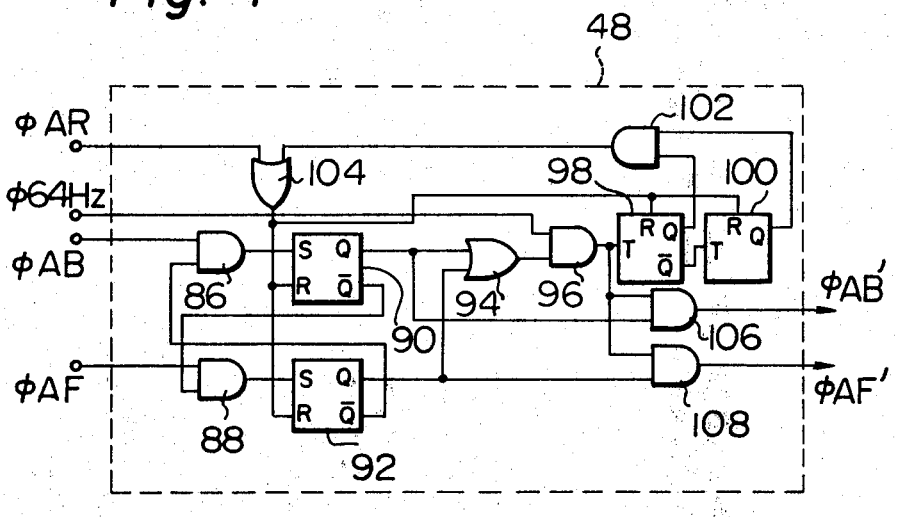
FIG. 4 is a circuit diagram of a circuit according to the present invention for producing signals whereby the hands of the embodiment of FIG. 1 are advanced in one-minute steps during setting of an alarm time.

Referring now to FIG. 4, the circuit diagram of alarm time setting pulse generating circuit 48 is shown. This comprises AND gates 86, 88, 96, 102, 106, and 108, OR gates 94 and 104, RS-FFs 90 and 92 and toggle-type flip-flops (abbreviated hereinafter to T-FF) 98 and 100. When the timepiece is set in the alarm time setting mode, as described hereinabove, then when crown 18 is rotated in the clockwise direction to designate correction of the positions of minutes hand 14 and hours hand 16 by clockwise rotation, then for each switch actuation performed by this rotation of crown 18 (i.e. in correspondence with each "click" emitted during this rotation), a pulse of a time setting switch signal $\phi$AF will be generated from switch control circuit 46 and applied to circuit 48, i.e. to an input of AND gate 86. Similarly if crown 18 is rotated in the counterclockwise direction, to designate correction of the positions of minutes hand 14 and hours hand 16 by rotation in the counterclockwise direction, then a pulse of time setting switch signal $\phi$BF will be generated from switch control circuit 46 for each switch actuation by crown 18 in its rotation. Switch signal $\phi$AB is applied to an input of AND gate 86 of circuit 48. The outputs of AND gates 86 and 88 are applied to the set terminals S of RS-FFs 90 and 92 respectively, while the outputs Q of these RS-FFs are applied to the inputs of OR gate 94. The $\overline{Q}$ output of RS-FF 90 is applied to the other input of AND gate 88, while the $\overline{Q}$ output of RS-FF92 is applied to the other input of AND gate 86. The output of OR gate 94 is coupled to an input of AND gate 96, while the $\phi$64 Hz timing pulse signal train is applied to the other input of AND gate 96. The output of AND gate 96 is applied to the toggle input T of T-FF 98, and to inputs of AND gates 106 and 108, while output Q from RS-FF 90 is applied to the other input of AND gate 106, and the Q output from RS-FF 92 is applied to the other input of AND gate 108. The output signals from AND gates 106 and 108 are designated as $\phi$AB′ and $\phi$AF′ respectively, and during alarm time setting these signals are applied to timekeeping function circuit 44 to be counted by secondary counter circuit 60, and also to the input of motor drive circuit 40. Drive pulses are generated thereby, so that minutes hand 14 and hours hand 16 are rotated by step of 20 seconds in the clockwise direction for each pulse of signal $\phi$AF′, and by a step of 20 seconds in the counterclockwise direction for each pulse of signal $\phi$BF′.

The Q outputs of T-FFs 98 and 100 are applied to inputs of AND gate 102, whose output is applied to OR gate 104. The "all reset" signal $\phi$AR is applied to the other input of OR gate 104, whose output is coupled to the reset terminals R of RS-FFs 90 and 92 and of T-FFs 98 and 100.

The operation of the circuit of FIG. 4 will now be described. Normally, both of RS-FFs 90 and 92 will be in the reset state, as a result of the $\phi$AR signal, or an output signal produced from AND gate 102 as described hereinafter. If the timepiece is set into the alarm time setting mode, as described hereinabove, and crown 18 is rotated in the clockwise direction, then pulses of signal $\phi$AF will begin to be produced. When the first of these pulses is applied to AND gate 88, then this gate will be in the enabled state due to the reset state of RS-FF 90. Thus, the output from AND gate 88 will set RS-FF 92, whose Q output will thereby enable AND gate 108, and will act through OR gate 94 to enable AND gate 96. Pulses of timing signal $\phi$64 Hz will thereby be transferred through AND gate 96 to the T input of T-FF 98. T-FF 98 and T-FF 100 constitute a counter circuit, and it will be apparent that when three pulses of the $\phi$64 Hz signal have been counted by this counter circuit, the Q outputs of both T-FF98 and T-FF 100 will be at the H level, whereby the output of AND gate 102 goes to the H level, thereby acting through OR gate 104 to reset RS-FFs 90 and 92, and also T-FFs 98 and 100. AND gates 96 and 108 thereby become inhibited once more. Thus, it can be seen that 3 pulses of the $\phi$64 Hz timing signal will have been transferred through AND gate 108 as signal $\phi$AF', in response to the first pulse of signal $\phi$AB described above. The minutes hand 14 and hours hand 16 will therefore have been rotated through three successive steps of 20 seconds, i.e. through precisely one minute, in response to that pulse of switch signal $\phi$AB. When the next pulse of switch signal $\phi$AF is generated by further rotation of crown 18, then the sequence of operations described above will be repeated, so that another set of three pulses are output as signal $\phi$AF' to advance minutes hand 14 and hours hand 16 through another step of one minute. In this way, as the user rotates crown 18 in the clockwise direction, in the alarm time setting mode, minutes hand 14 and hours hand 16 will be successively rotated clockwise in steps of one minute at a time.

Similarly, if crown 18 is rotated in the counterclockwise direction during the alarm time setting mode, then each pulse of switch signal $\phi$AB resulting from this rotation will be transferred through AND gate 86, which is enabled by the $\overline{Q}$ output of RS-FF 92, thereby setting RS-FF 90. The H level of the Q output from RS-FF 90 thereby enables AND gate 106 and acts through OR gate 94 to enable AND gate 96. Thus, three pulses of the $\phi$64 Hz timing signal will be counted by the counter circuit comprising T-FFs 98 and 100, and transferred through AND gate 106 as signal $\phi$AB', before AND gates 96 and 106 are once more inhibited. The minutes hand 14 and hours hand 16 will thereby be rotated in the counterclockwise direction by three steps of 20 seconds, i.e. by precisely one minute, in response to each pulse of switch signal $\phi$AB.

As stated previously, pulses of alarm time setting signals $\phi$AF' or $\phi$AB' generated during alarm time setting are input to secondary counter circuit 60 of timekeeping function circuit 44, to be counted therein. Upon completion of setting minutes hand 14 and hours hand 16 to indicate a desired alarm time, the user returns crown 18 from outward position 26 to the normal position 22. A switch signal is thereby generated from switch control circuit 46 which activates changeover control circuit 38 to apply timing signal pulses (e.g. at a frequency of 2048 Hz) simultaneously to main counter circuit 58 and secondary counter circuit 60 of timekeeping function circuit 44, until the maximum count of secondary counter circuit 60 is reached and the contents thereof reset to zero. As a result, the count in main counter circuit 58 now represents the alarm time which has just been set in. Operations to perform changeover from the alarm time to the current time display mode will then be initiated when the user depresses crown 18 into inward position 24, as described hereinabove.

From the above it will be understood that the method of the present invention enables alarm time setting to be easily and rapidly performed, with an analog electronic timepiece equipped with an alarm function, and that an alarm time can be precisely set in terms of minutes and hours without the necessity for the user to be extremely careful in observing the timepiece display during the operations of setting an alarm time. The present invention therefore enables an alarm time function having the advantages of high setting accuracy and ease of setting, hitherto only available with digital timepieces or combined analog-digital timepieces, to be provided on an analog type of electronic timepiece also.

The alarm time setting method of the present invention is not limited to use in a timepiece provided with a timekeeping function circuit of the form described in the above embodiment, but is also applicable to various other types of circuit means for storing data representing the time difference between a preset alarm time and the current time. For example, although the timekeeping function circuit in the above embodiment employs up-counter circuits for main counter circuit 58 and secondary counter circuit 60, it is equally possible to utilize up-down counter circuits for these.

Furthermore, although in the above embodiment the timepiece hands are advanced in steps of 20 seconds at a time during the current time display mode, the present invention is also applicable to timepieces in which the hands are advanced by steps of different amplitude during current time display, for example steps of 1 second, 5 seconds, . . . 30 seconds, etc. The basic feature of the present invention is that, for each switch pulse generated during alarm time setting, (i.e. switch signal pulses which the user can generate, one pulse at a time, by actuation of an external operating member), a plurality of alarm time setting pulses are generated by an alarm time setting signal generating circuit, with the number of these alarm time setting pulses being equal to the number of times the timepiece hands are advanced per minute during the current time display mode. Thus in general if the timepiece hands are driven by steps of n seconds per minute during current time display, then 60/n alarm time setting pulses will be generated in response to each of the alarm time setting switch signal pulses, during alarm time setting, whereby an electromechanical transducer driving the timepiece hands is actuated n times in succession. Here, n is an integer within the range 1 to 30.

Although the present invention has been described with reference to an embodiment in which a rotatable crown is utilized as an external operating member coupled to switches for generating alarm time setting signals, the present invention is equally applicable to a timepiece in which other types of external operating members are used to generate alarm setting signals, such as pushbutton switches.

From the preceding description, it will be apparent that the objectives set forth for the present invention are effectively attained. Since various changes and modifications to the above construction may be made without departing from the spirit and scope of the present invention, it is intended that all matter contained in the above description or shown in the accompanying drawings shall be interpreted as illustrative. and not in a limiting sense. The appended claims are intended to cover all of the generic and specific features of the invention described herein.

What is claimed is:

1. An analog electronic timepiece provided with an alarm function, comprising:

display means comprising time indicating hands;

an electro-mechanical transducer coupled to said display means for rotating said hands;

transducer drive circuit means for generating drive signals to activate said electro-mechanical transducer to rotate said hands;

circuit means for generating a unit time signal comprising a pulse train of period 60/n seconds, where n is an integer, and a plurality of timing signal pulse trains of shorter period than said unit time signal;

externally operable switch means, actuatable for generating signals selectively designating operation in a current time display mode in which current time is indicated by said hands, a current time setting mode in which said current time indication can be corrected, an alarm time display mode in which a preset alarm time is indicated by said hands and an alarm time setting mode in which said preset alarm time can be corrected, and further actuatable in said current time setting mode and alarm time setting mode for generating time setting signal pulses;

a timekeeping function circuit for storing data representing the difference between said preset alarm time and the current time, and for producing an alarm coincidence signal when said difference becomes zero as the current time reaches coincidence with said alarm time;

alarm signal generating means for generating an audible alarm signal in response to said alarm coincidence signal;

changeover control circuit means responsive to signals from said externally operable switch means designating changeover from operation in said current time display mode to said alarm time display mode for generating signals which are applied to said transducer drive circuit means in accordance with said data in said timekeeping function circuit for thereby driving said electro-mechanical transducer to rotate said hands from positions indicating current time into positions indicating said preset alarm time, and for generating signals which act to rotate said hands into positions indicating current time, from said alarm time indicating positions, when signals from said switch means designate changeover from said alarm time to said current time display mode, said changeover control circuit means operating during said current time display mode to transfer said unit time signal pulses to said drive circuit means, which is responsive thereto for driving said electro-mechanical transducer to advance said hands by one step for each of said unit time signal pulses, and further operating during said current time and alarm time display modes for transferring said unit time signal pulses to said timekeeping function circuit means to thereby successively decrement said data representing the difference between said alarm time and current time; and alarm time setting signal generating circuit means responsive to each pulse of said time setting signal during said alarm time setting mode for generating n alarm time setting pulses, where n is said integer, said alarm time setting pulses being transferred to said transducer drive circuit means for thereby producing drive signals to rotate said hands by n steps and therefore by an amount representing one minute, for each of said time setting signal pulses, said alarm time setting pulses being further transferred to said timekeeping function circuit means for correcting said data held therein representing the difference between the alarm time and current time.

2. An analog electronic timepiece according to claim 1, in which said alarm time setting signal generating circuit means comprise a counter circuit which is enabled to count n pulses of one of said timing signal pulse trains in response to each of said time setting signal pulses, and gate circuit means which are enabled to transfer n pulses of said timing signal, to be output as said alarm time setting pulses, while counting by said counter circuit is taking place.

3. An analog electronic timepiece according to claim 1, in which said electro-mechanical transducer comprises a reversible miniature stepping motor, operable to selectively rotate said hands in the clockwise and counterclockwise directions in accordance with input signals applied to said transducer drive circuit means.

4. An analog electronic timepiece according to claim 3, in which said externally operable switch means are actuatable in said alarm time setting mode to selectively first time setting signal pulses designating clockwise rotation of said hands and second time setting signal pulses designating counterclockwise rotation of said hands, and in which said alarm time setting signal generating circuit means are responsive to said first time setting signal pulses for generating alarm time setting pulses designating clockwise rotation of said hands and are responsive to said second time setting signal pulses for generating alarm time setting pulses designating counterclockwise rotation of said hands.

5. An analog electronic timepiece according to claim 4, in which said externally operable switch means comprise a rotatable crown and switch means coupled to be actuated thereby, and switch control circuit means responsive to actuations of said switch means by rotation of said crown in a first direction of rotation for generating said first time setting signal pulses and responsive to rotation of said crown in a second direction of rotation for generating said second time setting signal pulses.

* * * * *